US008262143B2

(12) United States Patent
Giacomin

(10) Patent No.: US 8,262,143 B2
(45) Date of Patent: Sep. 11, 2012

(54) DRIVING DEVICE FOR ACTUATING A LATCH VIA A LOCK

(75) Inventor: Fabrice Giacomin, Creteil Cedex (FR)

(73) Assignee: Valeo Securite Habitacle S.A.S., Créteil (FR)

( * ) Notice: Subject to any disclaimer, the term of this patent is extended or adjusted under 35 U.S.C. 154(b) by 0 days.

(21) Appl. No.: 12/067,012

(22) PCT Filed: Sep. 14, 2006

(86) PCT No.: PCT/EP2006/066351

§ 371 (c)(1),
(2), (4) Date: Mar. 14, 2008

(87) PCT Pub. No.: WO2007/031549

PCT Pub. Date: Mar. 22, 2007

(65) Prior Publication Data

US 2008/0224479 A1 Sep. 18, 2008

(30) Foreign Application Priority Data

Sep. 15, 2005 (FR) ..... 05 09425

(51) Int. Cl.
*E05B 33/00* (2006.01)

(52) U.S. Cl. ..... 292/336.3; 292/DIG. 64; 292/201; 292/DIG. 23

(58) Field of Classification Search ..... 292/336.3, 292/1, DIG. 64, DIG. 54, DIG. 53, 359, DIG. 23, 292/216, 201
See application file for complete search history.

(56) References Cited

U.S. PATENT DOCUMENTS

| | | | | |
|---|---|---|---|---|
| 4,927,203 | A * | 5/1990 | Mayer et al. | 292/201 |
| 5,046,377 | A * | 9/1991 | Wilkes et al. | 74/431 |
| 5,647,234 | A * | 7/1997 | Foster | 70/256 |
| 5,722,272 | A * | 3/1998 | Bridgeman et al. | 70/264 |
| 6,803,733 | B1 * | 10/2004 | Shabana et al. | 318/280 |

FOREIGN PATENT DOCUMENTS

| | | | |
|---|---|---|---|
| DE | 19823188 | A1 * | 12/1999 |
| DE | 19955693 | A1 * | 5/2001 |
| EP | 1 416 109 | | 5/2004 |
| EP | 1 580 358 | | 9/2005 |
| EP | 1580351 | A1 * | 9/2005 |
| FR | 2 847 290 | | 5/2004 |
| FR | 2 868 105 | | 9/2005 |

OTHER PUBLICATIONS

International Search Report (French & English) for PCT/EP2006/066351 mailed Nov. 29, 2006 (7 pages).
Written Opinion of ISA (French only) for PCT/EP2006/066351 mailed Nov. 29, 2006 (5 pages).

* cited by examiner

*Primary Examiner* — Carlos Lugo
*Assistant Examiner* — Mark Williams
(74) *Attorney, Agent, or Firm* — Osha Liang LLP

(57) ABSTRACT

A driving device for actuating a latch via a lock, for a motor-vehicle door closure system, includes a coupling element including a longitudinal body having ends capable of being rotatably coupled with a part, mounted movably in axial rotation, of the lock and with a part, mounted movably in axial rotation, of the latch. At least one cylinder made from rigid plastic is fixed on the body such that longitudinal portions of the body left visible are smaller than 20 mm (millimeters).

17 Claims, 2 Drawing Sheets

DRIVING DEVICE FOR ACTUATING A LATCH VIA A LOCK

FIELD OF THE INVENTION

The present invention relates to a driving device for actuating a latch via a lock.

The invention applies particularly advantageously, but not exclusively, to the field of motor-vehicle door closures.

BACKGROUND OF THE INVENTION

In a motor-vehicle door, the lock and the latch associated therewith are generally installed at a distance from one another and, above all, at different levels. In order for the lock to be able to control operation of the latch despite this particular relative positioning, it is known to use a driving device that mechanically connects the movable part of said lock to that of said latch.

The driving device generally takes the form of a rotating coupling element whose one end is coupled with an axially rotating movable part of the lock via a universal joint-type link. The other end of the coupling element is also rotatably coupled, still by means of a universal joint link, but this time with an axially rotating movable part of the latch. The rotationally movable parts in question are usually constituted by the lock barrel and by the external control lever of the latch, respectively.

This type of arrangement nevertheless has the drawback of being extremely vulnerable to tampering. The coupling element is in fact relatively easy to access from the outside if, first, the rubber seal component between the window and the sheet metal outer panel of the door is removed and if, second, said panel is separated from said window as far as possible using an inflatable balloon, for example. It is then not difficult to make sufficient space to allow the insertion of multi-grip pliers with the aim of gripping the coupling element in order to forcibly rotate it. The universal joint is indeed held by the lock, but if a sufficiently high degree of torque is applied it is possible to break at least one component of the rotation drive train, i.e. to cause a breakage inside the lock and/or of the coupling element and/or at the interface between these two members. If a torque continues to be applied thereto via the pliers, the coupling element will actually be rotated. As the coupling element is, furthermore, still coupled with the control lever of the latch, rotation thereof will thus cause said lock to be unlocked. All that remains is then to pull the handle, and the door will open.

In order substantially to reduce the vulnerability of such a device, it is generally proposed to add a fixed cap that covers the coupling element.

Another method consists in increasing the coupling element's resistance to torque.

Unfortunately, these various solutions have the drawback of being less compact.

Thus, the technical problem to be solved by the subject of the present invention is to propose a driving device for actuating a latch via a lock, in particular for a motor-vehicle door closure system, that includes a coupling element whose ends are capable, respectively, of being rotatably coupled with a part, mounted movably in axial rotation, of the lock on the one hand and with a part, mounted movably in axial rotation, of the latch on the other, a driving device of this type making it possible to avoid the prior-art problems by offering, in particular, enhanced compactness and a substantially improved resistance to tampering.

SUMMARY OF THE INVENTION

The present invention relates to a driving device for actuating a latch via a lock, in particular for a motor-vehicle door closure system, that includes a coupling element 30 whose longitudinal body 40 has ends 43 and 44 that are capable, respectively, of being rotatably coupled with a part, mounted movably in axial rotation, of the lock 10 on the one hand and with a part, mounted movably in axial rotation, of the latch 20 on the other, characterized in that the body 40 of the coupling element includes at least one cylinder 50 made from rigid plastic and fixed on said body 40 such that the longitudinal portions of the body 40 left visible are smaller than 20 mm (millimeters).

"Visible longitudinal portions" of the coupling element body is understood to mean the parts not covered or protected by the plastic cylinder, when they are considered in the longitudinal direction of the coupling element body.

Furthermore, the plastic will be called "rigid" because it has a low, or very low, elastic deformation. By way of example of a plastic used, mention may be made of POM (polyoxymethylene), PA (polyamide), PBT (polybutylene terephthalate), ABS (acrylonitrile butadiene styrene), PUs (polyurethanes) or epoxies.

The longitudinal portions of the body left visible have been limited to 20 mm (millimeters) in order to make it more difficult for the device to be attacked using a conventional tool that grips a visible zone, i.e. a zone not entirely covered or protected by the cylinders, of the coupling element body, thereby forcing it to rotate.

Further advantages of the invention will be apparent from the following optional characteristics:

- the cylinders are overmolded on the coupling element body,
- the plastic of the overmolded cylinders has a coefficient of friction on the coupling element body of less than 0.4,
- the overmolded cylinders are connected together via at least one overmolded coupling zone,
- the cylinders are fixed on the coupling element body by adhesive bonding,
- the longitudinal portions of the body 40 left visible are less than 12 mm and preferably less than 5 mm, and in this configuration it is impossible, using a conventional tool to force the driving device, to be able to grip a zone, not entirely covered or protected by the cylinders, of the coupling element body, thus forcing it to rotate,
- the torque exerted on a cylinder so that it separates from the element body is strictly lower than the torque required for interrupting the drive train of the rotational movement between the lock and the coupling element,
- the coupling element body is made from metal or ceramic,
- the ends of the coupling element body are overmolded,
- the plastic of the cylinders fixed on the coupling element body is constituted by a matrix and a reinforcement,
- the plastic of the cylinders fixed on the coupling element body is POM, PA or PBT, optionally with a reinforcement,
- the cylinder fixed on the coupling element body covers practically all thereof,
- a plurality of cylinders fixed on the coupling element body covers practically all thereof.

As the plastic cylinders are overmolded or fixed by adhesive bonding, exerting, on one or more cylinders, a torque lower than the torque necessary to interrupt the drive train of the rotational movement between the lock and the coupling element will be sufficient for said cylinder(s) to detach from the coupling element body, thereby becoming free to rotate relative to the latter.

Furthermore, after detachment, as the cylinders have been overmolded or fixed by adhesive bonding the cylinder interface or cylinder plus adhesive with the coupling element body has zero play. Thus, the device according to the invention offers a lower vibration level.

Furthermore, owing to their inherent rigidity, the protective cylinders are capable of individually withstanding the deformation forces likely to be applied to them, particularly during an attempt to crush them using pliers. In this respect, it will be understood that the inherent rigidity of the cylinders may arise, in particular, from the nature of the material of which they are composed and/or their structure and/or their dimensions.

Within the context of the invention, the fact that the protective cylinders are rigid therefore means that they are substantially non-deformable vis-à-vis at least such crushing forces as are likely to be generated when a conventional gripping tool is wielded manually.

Obviously, it would be ideal for the protective cylinders not to deform at all, in order to retain their freedom to rotate axially relative to the coupling element. There would then be no possibility of axially rotating the coupling element from the outside, which enhances the tamperproof nature of the closure system.

However, a similar result may be obtained if the protective cylinders deform slightly. Indeed, if crushing is not too great, gripping between the protective cylinders and the coupling element is insufficient for it to be possible for a high enough torque to break one of the lock components to be transmitted. There will indeed be a torque that can be transmitted by the protective cylinders, but it is much less than the torque required to interrupt the transmission train of the rotation movement between the lock and the coupling element.

"Covers practically all the coupling element" will be understood to mean that at least 90% of the surface of the coupling element is covered by the cylinders that are overmolded or fixed by adhesive bonding.

"Coefficient of friction μ" will be understood usually to mean the ratio of the friction force to a force, customarily gravity, acting perpendicularly to the two contact surfaces.

By virtue of a low inherent coefficient of friction, the protective cylinders, after they have been detached from the coupling element body, will be free to rotate axially. There will then be no possibility of axially rotating the coupling element from the outside, which enhances the tamperproof nature of the closure system. It will be understood that the low inherent coefficient of friction of the cylinders emanates from the nature of the material of which they are composed.

The invention as defined thus offers the advantage of protecting that portion of the coupling element that is neither integrated into the lock nor integrated into the latch and is theoretically accessible in prior-art closure systems. During a forcible attack using pliers, the overmolded cylinders will become detached and will be able to turn freely about the coupling element body. The cylinders then form a movable interface that prevents direct grasping of the coupling element, preventing it being possible for a torque to be applied axially to the coupling element with a view to forcing the closure system with which the driving device is associated. It will thus be impossible to transmit sufficient torque to the latch and to unlock the door.

The present invention also relates to the characteristics that will become apparent during the following description and which should be considered in isolation or in accordance with all their possible technical combinations.

BRIEF DESCRIPTION OF THE DRAWINGS

The description, given by way of non-limiting example, relates to one embodiment concerning the fixing of the cylinders by means of overmolding. Naturally, the same functions could be obtained with the cylinders being fixed by adhesive bonding. This description will afford a better understanding of how the invention may be embodied, with reference to the appended drawings, in which.

DETAILED DESCRIPTION

Figure 1:
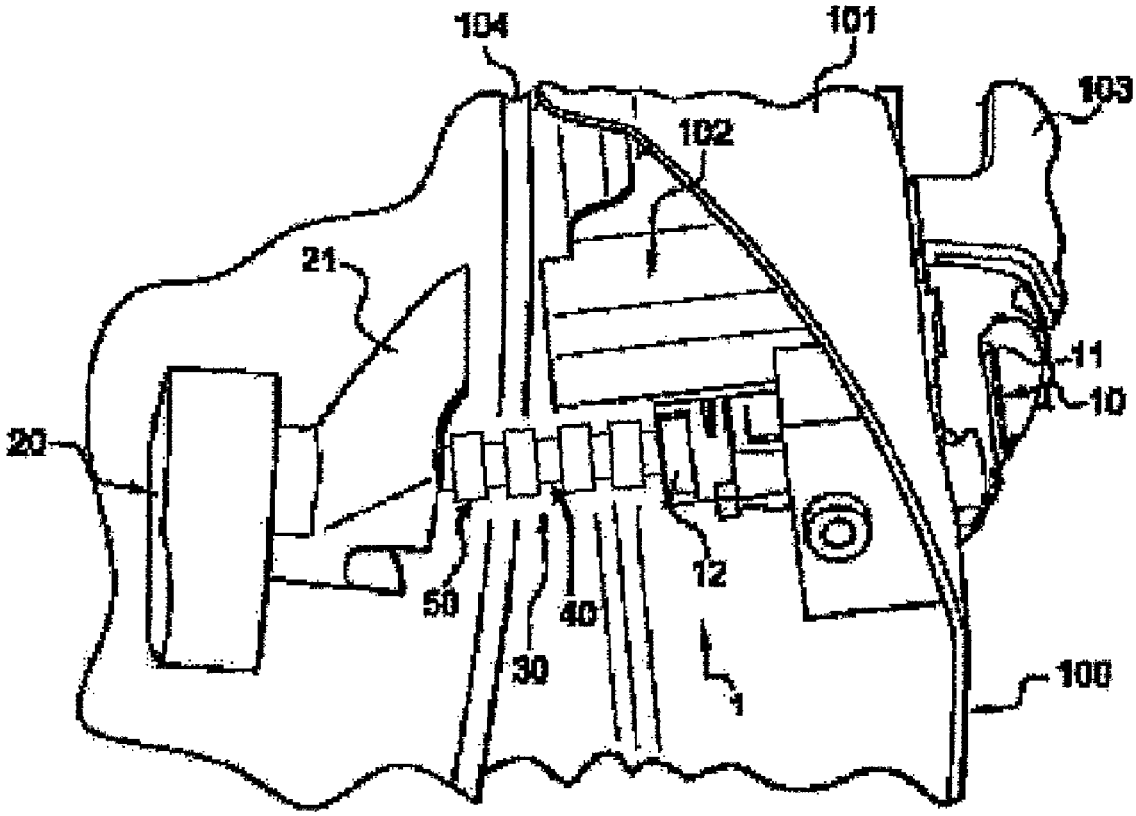
FIG. 1 is a cross-sectional view of a motor-vehicle door provided with a closure system that includes a lock and a latch coupled by means of a driving device according to the invention.

For reasons of clarity, the same elements have been denoted by identical reference numerals. Similarly, only those elements that are essential for an understanding of the invention have been shown, irrespective of scale and schematically.

FIG. 1 illustrates a motor-vehicle door 100 that is conventionally provided with a closure system 1 composed essentially of a lock 10 and a latch 20. Specifically, the lock 10 is installed through an outer panel 101 of the door 100 by means of a holding module 102 that furthermore supports an opening handle 103. The assembly is arranged such that the head 11 of the lock 10 emerges on the outside. The latch 20 is arranged further inside the door 100, beyond a window 104 that, in this case, extends rearwards.

In this first representation, it will be clearly noted that the lock 10 and the latch 20 are arranged at a distance from one another and at different levels. In order for the lock 10, however, to be able to fulfill its principal function, i.e. locking and/or unlocking the latch 20, the closure system 1 is further provided with a driving device 30 that mechanically connects a movable part of said lock 10 to a movable part of said latch 20.

In this particular embodiment, which is provided solely by way of example, the driving device 30 is rotatably coupled with the barrel 12 of the lock 10 and a control lever 21 of the latch 20, respectively. It should be noted that the control lever 21 in question here has a deflecting cone that enables it to interact during entrainment with the driving device 30, despite the offset of the axis of the lock 10 relative to the axis of the latch 20. It will also be observed that the latch 20 has been only partially represented here, simply for reasons of clarity.

Figure 2:
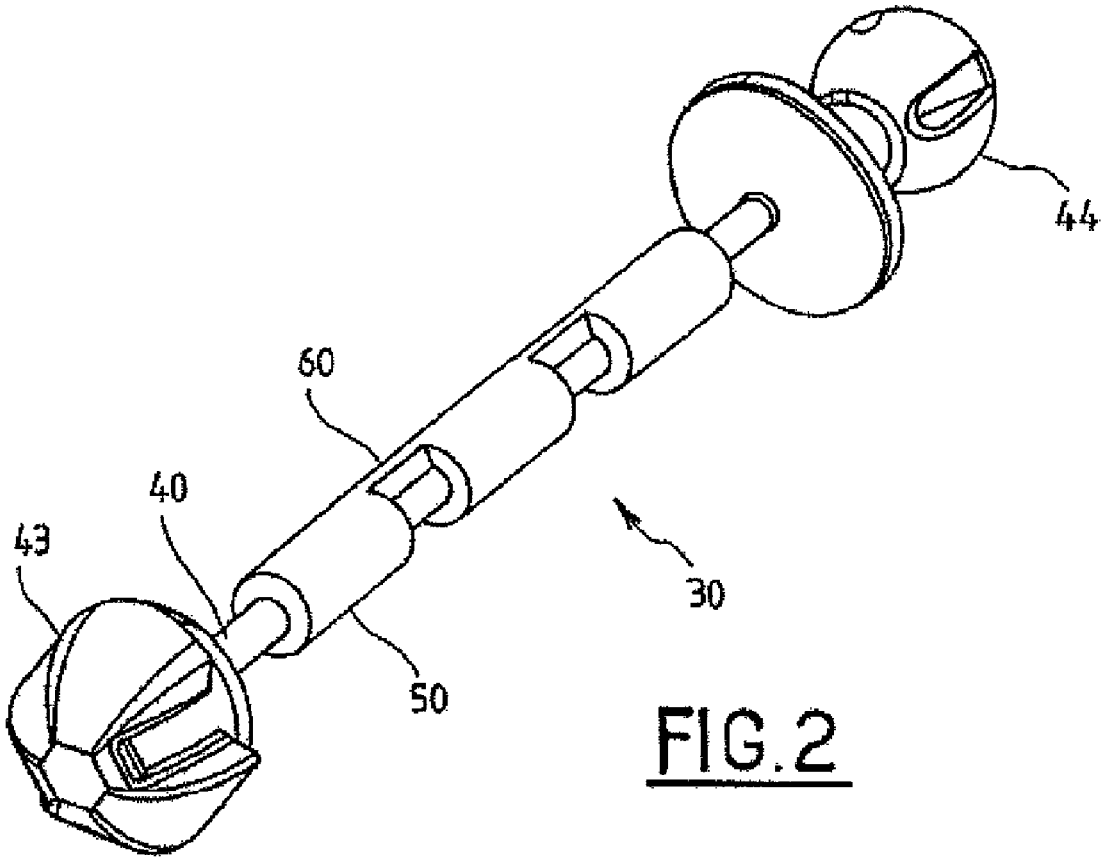
FIG. 2 specifically illustrates the driving device of FIG. 1, which is in accordance with a first embodiment of the invention.

As may be seen more clearly in FIG. 2, the driving device 30 is provided with a coupling element 40 whose ends 43, 44 are, respectively, capable of being rotatably coupled via universal joint-type links with a part, mounted movably in axial rotation, of the lock 10, namely the barrel 12, and with a part, mounted movably in axial rotation, of the latch 20, in this case the control lever 21.

The coupling element 40 is made from steel, which makes it possible to reduce its cross section, as opposed to Zamak, or plastic, without thereby reducing its resistance to torque.

As the assembly of the driving device 30 and, in particular, the two ends 43, 44 is difficult to produce from steel, the ends of the body in steel of the coupling elements 40 are first flattened and then the two coupling end pieces 43 and 44 are overmolded thereon.

Furthermore, and in accordance with the subject of the present invention, the driving device 30 includes, on the steel body of the coupling elements 40, one or more cylinders 50 overmolded in rigid plastic that has a low coefficient friction.

According to the first embodiment illustrated FIGS. 1 and 2, the protective cylinders are distributed over the entire length of the element 40, with a small space separating one cylinder from another and a small space separating the outer cylinders from the coupling end pieces 43 and 44. This small space is necessary to prevent a tool, used to force the closure system, from being able to gain access to an uncovered zone of the element 40.

Furthermore, in order to facilitate the injection-molding operation, the cylinders are overmolded during a single operation using a reduced number of injection point. To that end, one or more channels of small dimensions are made in the mold between the zones used for the overmolding of the cylinders. The material to be injected can thus pass from a zone of one cylinder where overmolding is to take place to another. When the mold is removed, the result is a plurality of cylinder with a linking zone 60 between them. Preferably, for cylinders 10 mm in length and 1 mm in thickness the linking zones will be 5/10 to 1 mm wide, 1 mm thick and 5 mm long.

The plastic used in accordance with the present invention must offer good mechanical strength and a coefficient of friction μ on steel of less than 0.4. POM (polyoxymethylene), PA (polyamide) or PET (polybutylene terephthalate) are examples of materials offering such characteristics. These various materials may be used in charged or uncharged form.

The coupling element is generally sized in order to be able to rotate a torque of at least 5 Nm (Newton meter) before rupture.

In accordance with the present invention, when a tool used to force the closure system grips the coupling element it is necessarily in contact with the surface of one or more protective cylinders, which at this stage are secured to the steel body of the coupling element via a plastic/steel link. Owing to the low linking force, a torque of the order of 1 to 2 Nm (Newton meter), which is much less than the torque (>5 Nm) required to rupture the drive chain of the rotational movement between the lock and the coupling element, suffices to cause detachment of the cylinder(s) with which the tool was in contact. Once to detach, the cylinder(s) may rotate freely about the axis of the coupling element. It will be clearly understood that the linking zones between two cylinders, given their small dimensions, will soon break. The cylinder(s) forms/form a kind of movable interface that prevents direct grasping of the coupling element, making it impossible for a torque to be applied axially thereto with a view to forcing the closure system with which the driving device is associated.

Figure 3:
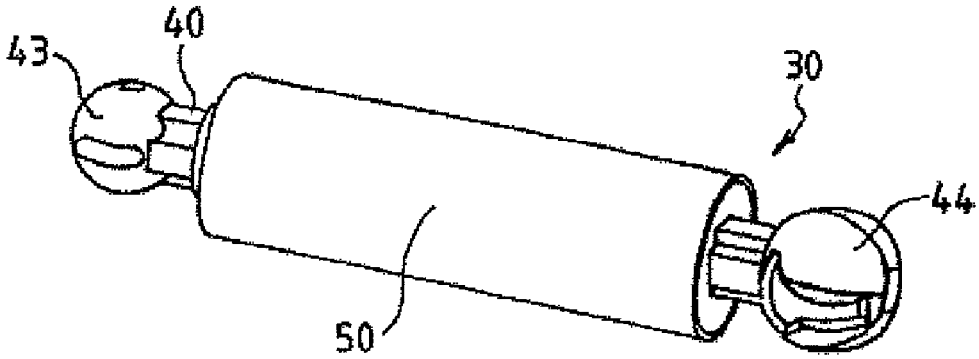
FIG. 3 specifically illustrates the driving device of FIG. 1, which is in accordance with a second embodiment of the invention.

In the second embodiment, illustrated in FIG. 3, a single cylinder 50 substantially covers all the steel body 40 of the coupling element. The body 40 of the coupling element 30 in fact refers to the entire central part extending between the two interfaces 43 and 44, which are designed to be rotatably coupled with the lock 10 and the latch 20, respectively, which for this reason are designed to be incorporated inside said lock 10 and said latch 20 and which are consequently practically inaccessible.

In a manner similar to that of the first embodiment, when a tool used to force the closure system grips the coupling element 30 it is necessarily in contact with the surface of the protective cylinder 50, which at this stage is secured to the steel body 40 of the coupling element 30 via a plastic/steel link. Owing to the low linking strength, a torque of the order of 1 to 2 Nm, much less than the torque (>5 Nm) required to interrupt the drive train of the rotational movement between the lock and the coupling element, suffices to cause the detachment of the protective cylinder 50 with which the tool was in contact. Once to detach, the cylinder 50 can rotate freely about the axis of the coupling element 30. The cylinder 50 then forms a kind of movable interface that prevents direct grasping of the coupling element 30, making it impossible for a torque to be applied axially thereto with a view to forcing the closure system with which the driving device is associated.

Naturally, the invention also relates to any closure system 1 provided with a lock 10 and a latch 20 in which said lock 10 is able to actuate said latch 20 by means of a driving device 30, as described above.

Yet more generally, the invention further relates to any motor vehicle provided with at least one closure system 1 as described above.

The invention claimed is:

1. A driving device for a motor-vehicle door closure system, wherein the driving device is used to actuate a latch via a lock, the driving device comprising:

a coupling element comprising a longitudinal body, the coupling element comprising:

a first end capable of being rotatably coupled with a part of the lock, wherein the first end is movably mounted such that the first end moves in axial rotation about a first axis of the lock, a second end capable of being rotatably coupled with a part of the latch, wherein the second end is mounted such that the second end moves movably in axial rotation about a second axis of the latch, and at least one cylinder made from rigid plastic and fixed on the longitudinal body such that longitudinal portions of the body left visible are smaller than 20 mm (millimeters), wherein longitudinal portions of the body left visible is defined as portions of the longitudinal body not covered by the at least one cylinder, when considered from a longitudinal direction of the longitudinal body of the coupling element, wherein the at least one cylinder is secured to the body until a forced torque is applied to the at least one cylinder, wherein the at least one cylinder detaches from the longitudinal body and rotates freely around the longitudinal body under application of the forced torque, preventing direct grasping of the coupling element.

2. The driving device as claimed in claim 1, wherein the at least one cylinder is overmolded on the body.

3. The driving device as claimed in claim 2, wherein the rigid plastic of the overmolded at least one cylinder has a coefficient of friction on the body of less than 0.4.

4. The driving device as claimed in claim 1, further comprising a plurality of cylinders overmolded on the body, wherein the plurality of overmolded cylinders are connected together via at least one overmolded coupling zone.

5. The driving device as claimed in claim 1, wherein the at least one cylinder is fixed on the body by adhesive bonding.

6. The driving device as claimed in claim 1, wherein longitudinal portions of the body left visible are less than 12 mm.

7. The driving device as claimed in claim 1, wherein the torque exerted on the at least one cylinder required to separate the at least one cylinder from the body is lower than a torque required for interrupting a drive train of a rotational movement between the lock and the coupling element.

8. The driving device as claimed in claim 1, wherein the body is made from metal or ceramic.

9. The driving device as claimed in claim 1, wherein the first and second ends of the body are overmolded.

10. The driving device as claimed in claim 1, wherein the rigid plastic of the at least one cylinder fixed on the body is constituted by a matrix and a reinforcement.

11. The driving device as claimed in claim 10, wherein the rigid plastic of the at least one cylinder fixed on the body is POM, PA, or PBT.

12. The driving device as claimed in claim 1, wherein the at least one cylinder fixed on the body covers substantially all of the body.

13. The driving device as claimed in claim 1, wherein a plurality of cylinders fixed on the body covers substantially all of the body.

14. The driving device as claimed in claim 1, wherein the longitudinal portions of the body left visible are less than 5 mm.

15. The driving device as claimed in claim 1, further comprising a plurality of cylinders fixed on the body.

16. A closure system comprising a lock and a latch, wherein the lock is capable of actuating the latch by means of a driving device, wherein the driving device comprises:

a coupling element comprising a longitudinal body, the coupling element comprising:

a first end capable of being rotatably coupled with a part of the lock, wherein the first end is mounted such that the first end moves movably in axial rotation about a first axis of the lock, a second end capable of being rotatably coupled with a part of the latch, wherein the second end is movably mounted such that the second end moves in axial rotation about a second axis of the latch, and at least one cylinder made from rigid plastic and fixed on the longitudinal body such that longitudinal portions of the body left visible are smaller than 20 mm (millimeters), wherein longitudinal portions of the body left visible is defined as portions of the longitudinal body not covered by the at least one cylinder, when considered from a longitudinal direction of the longitudinal body of the coupling element, wherein the at least one cylinder is secured to the body until a forced torque is applied to the at least one cylinder, wherein the at least one cylinder detaches from the longitudinal body and rotates freely around the longitudinal body under application of the forced torque, preventing direct grasping of the coupling element.

17. The closure system as claimed in claim 16, wherein the closure system is used in a motor vehicle.

* * * * *